US010344425B1

(12) United States Patent
Beretzky

(10) Patent No.: US 10,344,425 B1
(45) Date of Patent: Jul. 9, 2019

(54) STOCKING PAIRING DEVICE

(71) Applicant: Stephen Beretzky, Palm Harbor, FL (US)

(72) Inventor: Stephen Beretzky, Palm Harbor, FL (US)

( * ) Notice: Subject to any disclaimer, the term of this patent is extended or adjusted under 35 U.S.C. 154(b) by 0 days.

(21) Appl. No.: 15/391,967

(22) Filed: Dec. 28, 2016

Related U.S. Application Data

(60) Provisional application No. 62/275,214, filed on Jan. 5, 2016, provisional application No. 62/274,392, filed on Jan. 4, 2016.

(51) Int. Cl.
*D06F 95/00* (2006.01)

(52) U.S. Cl.
CPC ..... *D06F 95/008* (2013.01)

(58) Field of Classification Search
CPC ..... D06F 95/008
See application file for complete search history.

(56) References Cited

U.S. PATENT DOCUMENTS 1,402,153 A * 1/1922 Dusinberre ..... B42F 1/006 132/277
2,685,193 A * 8/1954 Marymont ..... A44B 15/00 24/598.2
2,779,076 A * 1/1957 Schenck, Sr. ..... D06F 95/008 24/531
2,785,413 A * 3/1957 Cook ..... A41B 11/002 2/239
3,346,927 A * 10/1967 Tompkins ..... A47K 10/12 24/464
3,535,746 A * 10/1970 Thomas, Jr. ..... B65D 63/12 24/30.5 P
3,543,353 A * 12/1970 Meehan ..... B65D 63/10 24/16 PB
3,857,139 A * 12/1974 Turner ..... B65D 63/10 229/87.09
4,079,484 A * 3/1978 Nakama ..... B65D 63/12 24/16 PB
4,484,378 A * 11/1984 Kimura ..... F16L 3/233 24/16 PB
D280,180 S * 8/1985 Burt ..... D8/382
4,939,823 A * 7/1990 Klein ..... D06F 95/008 24/581.1
5,044,051 A * 9/1991 Klein ..... D06F 95/008 24/581.1
5,188,609 A * 2/1993 Bayless ..... A61M 25/02 604/174

(Continued)

*Primary Examiner* — Robert Sandy
*Assistant Examiner* — David M Upchurch

(57) ABSTRACT

A pair of arms includes a first arm and a second arm, each having a curvilinear configuration. Each arm has a lower portion and an upper portion. A U-shaped vertex couples the lower end of the lower portion of the first arm and the lower end of the lower portion of the second arm. A first outwardly curved portion has an upper end and a lower end. The lower end of the first outwardly curved portion is coupled to the upper end of the lower portion of the first arm. A second outwardly curved portion has an upper end and a lower end. The lower end of the second outwardly curved portion is coupled to the upper end of the lower portion of the second arm. First and second knobs are at the upper ends of the first and second outwardly curved portions respectively.

4 Claims, 2 Drawing Sheets

(56) References Cited

U.S. PATENT DOCUMENTS

| | | | | | |
|---|---|---|---|---|---|
| 5,440,791 | A * | 8/1995 | Guio | A44B 99/00 | 24/543 |
| 5,499,431 | A * | 3/1996 | Mortensen | A44B 99/00 | 24/30.5 T |
| 5,671,876 | A * | 9/1997 | Gardner | D06F 95/008 | 223/1 |
| 5,853,212 | A * | 12/1998 | Daniel | A63C 11/025 | 294/147 |
| 6,301,756 | B1 * | 10/2001 | Howard | A44B 99/00 | 24/327 |
| 6,830,055 | B1 * | 12/2004 | Frame | A45D 8/00 | 132/275 |
| D612,158 | S * | 3/2010 | Lehr | D6/328 | |
| D612,159 | S * | 3/2010 | Lehr | 6/328 | |
| 9,174,781 | B2 * | 11/2015 | Case | B62J 11/00 | |
| 2013/0037672 | A1 * | 2/2013 | Sanchez | B60R 7/10 | 248/303 |
| 2014/0137378 | A1 * | 5/2014 | Llerena | D06F 95/008 | 24/709.7 |
| 2015/0289699 | A1 * | 10/2015 | Gallup | A47G 29/10 | 211/175 |
| 2016/0009470 | A1 * | 1/2016 | Martinson | B65D 63/10 | 24/27 |

* cited by examiner

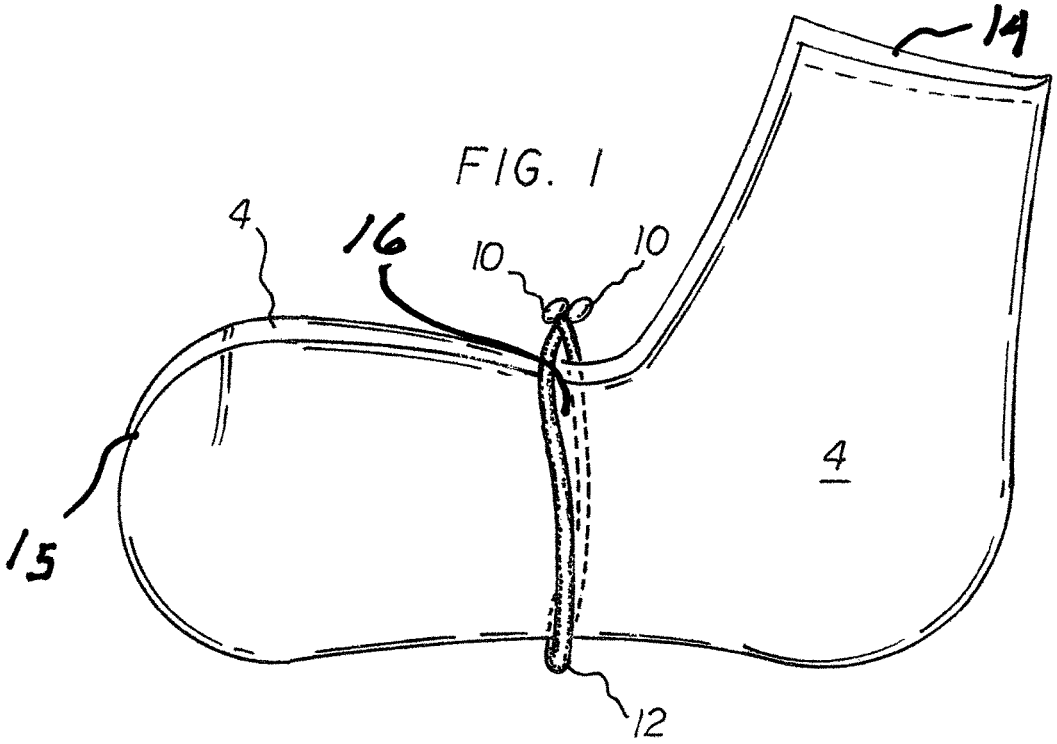
FIG. 1
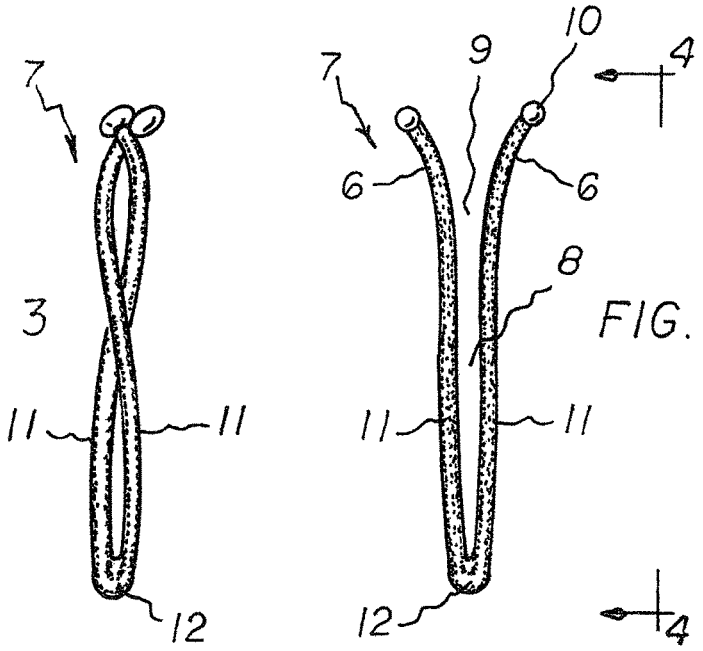
FIG. 3
FIG. 2

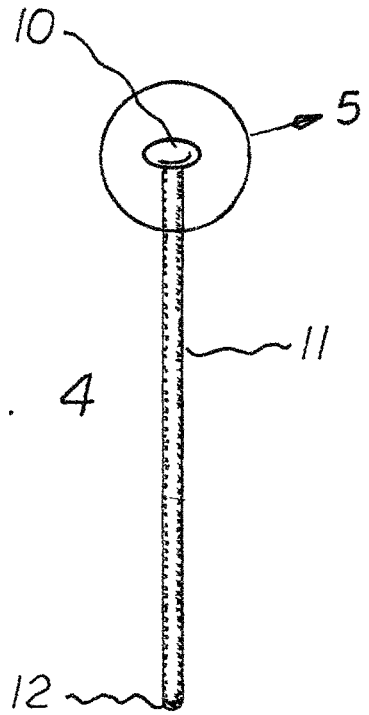
FIG. 4
FIG. 5
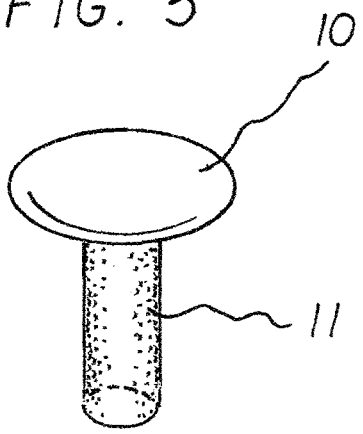
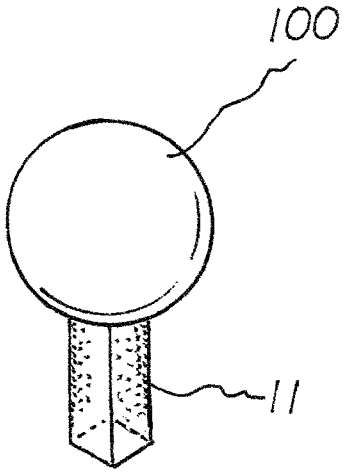
FIG. 6
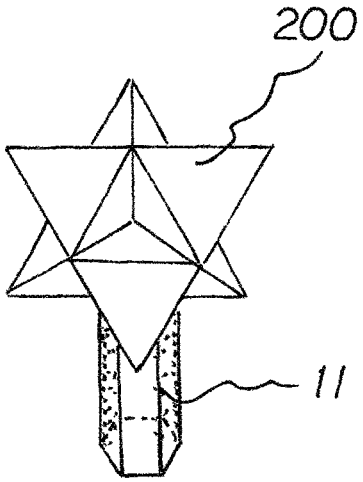
FIG. 7

STOCKING PAIRING DEVICE

RELATED APPLICATION

The present invention is based upon Provisional Applications 62/274,392 filed Jan. 4, 2016 and 62/275,214 filed Jan. 5, 2016, the priority of which applications is claimed and the subject matter of which is incorporated herein by reference.

BACKGROUND OF THE INVENTION

Field of the Invention

The present invention relates to a stocking pairing device and more particularly pertains to holding together a pair of stockings to be laundered and for securing and releasing such pair of stockings. The holding and securing and releasing is done quickly, easily, safely, and economically.

Description of the Prior Art

The use of stocking pairing devices is known in the prior art. More specifically, stocking pairing devices of known designs and configurations previously devised and utilized for the purpose of holding pairs of stockings together for laundering are known to consist basically of familiar, expected, and obvious structural configurations, notwithstanding the myriad designs encompassed by the crowded prior art which has been developed for the fulfillment of countless objectives and requirements.

While these devices fulfill their respective, particular objectives and requirements, they do not describe a stocking pairing device that allows for holding together a pair of stockings to be laundered and for securing and releasing such pair of stockings quickly, easily, safely, and economically as does the present invention.

Therefore, it can be appreciated that there exists a continuing need for a new and improved stocking pairing device which can be used for holding together a pair of stockings to be laundered and for securing and releasing such pair of stockings quickly, easily, safely, and economically. In this regard, the present invention substantially fulfills this need.

SUMMARY OF THE INVENTION

In view of the disadvantages inherent in the known types of stocking pairing devices of known designs and configurations now present in the prior art, the present invention provides an improved stocking pairing device. As such, the general purpose of the present invention, which will be described subsequently in greater detail, is to provide a new and improved stocking pairing device and method which has all the advantages of the prior art and none of the disadvantages.

To attain this, the present invention essentially comprises a pair of arms including a first arm and a second arm. Each arm has a curvilinear configuration. Each arm has a lower portion and an upper portion. A U-shaped vertex couples the lower end of the lower portion of the first arm and the lower end of the lower portion of the second arm. A first outwardly curved portion has an upper end and a lower end. The lower end of the first outwardly curved portion is coupled to the upper end of the lower portion of the first arm. A second outwardly curved portion has an upper end and a lower end. The lower end of the second outwardly curved portion is coupled to the upper end of the lower portion of the second arm. A first knob is provided at the upper end of the first outwardly curved portion and a second knob is provided at the upper end of the second outwardly curved portion.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved stocking pairing device which has all of the advantages of the prior art stocking pairing devices of known designs and configurations and none of the disadvantages.

It is another object of the present invention to provide a new and improved stocking pairing device which may be easily and efficiently manufactured and marketed.

It is a further object of the present invention to provide a new and improved stocking pairing device which is of durable and reliable constructions.

An even further object of the present invention is to provide a new and improved stocking pairing device which is susceptible of a low cost of manufacture with regard to both materials and labor, and which accordingly is then susceptible of low prices of sale to the consuming public, thereby making such stocking pairing device economically available to the buying public.

Lastly, even still another object of the present invention is to provide a stocking pairing device for holding together a pair of stockings to be laundered and for securing and releasing such pair of stockings. The holding and securing and releasing is done quickly, easily, safely, and economically.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated a range of preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a stocking pairing device constructed in accordance with the principles of the present invention, the device being illustrated in a closed operative orientation holding together a pair of stockings.

FIG. 2 is a front elevational view of the device illustrated in FIG. 1 but in the open orientation.

FIG. 3 is a front elevational view of the device illustrated in FIG. 1 but with the stockings removed.

FIG. 4 is a side elevational view taken along line 4-4 of FIG. 2.

FIG. 5 is an enlarged showing of the knob taken at circle 5 of FIG. 4.

FIG. 6 is a side elevational view of a knob constructed in a spherical configuration in accordance with an alternate embodiment of the invention.

FIG. 7 is a side elevational view of a knob constructed in a polyhedron configuration in accordance with other possible embodiments of the invention.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved stocking pairing device embodying the principles and concepts of the present invention and generally designated by the reference numeral 7 will be described.

The present invention, the stocking pairing device 7 is comprised of a plurality of components. Such components in their broadest context include a pair of arms, a U-shaped vertex, first and second outwardly curved portions, and first and second knobs. Such components are individually configured and correlated with respect to each other so as to attain the desired objective.

The pair of stockings 4 to be coupled together during laundering have a first end 14 and a second end 15. Intermediate between the first end and the second end is an intermediate extent 16 of the stockings.

The stocking pairing device 7 of the present invention is for holding together a pair of stockings 4 to be laundered and for securing and releasing such pair of stockings. The holding and securing and releasing is done quickly, easily, safely, and economically. Provided in the preferred embodiment are a pair of arms 11. The pair of arms includes a first arm and a second arm. Each arm has a curvilinear configuration with a length of 3.5 inches, plus or minus 20 percent. Each arm has a circular cross sectional configuration with a diameter of 0.125 inches, plus or minus 20 percent. Each arm has a lower portion and an upper portion. The arms have a circular cross sectional configuration with a first circumference.

Next provided is a U-shaped vertex 12 coupling the lower end of the lower portion of the first arm and the lower end of the lower portion of the second arm. The U-shaped vertex has a length of 0.25 inches, plus or minus 20 percent. The vertex has a second circumference greater than the first circumference of the arms.

A first outwardly curved portion 6 is next provided. The first outwardly curved portion has an upper end and a lower end. The lower end of the first outwardly curved portion is coupled to the upper end of the lower portion of the first arm. A second outwardly curved portion 6 is also provided. The second outwardly curved portion has an upper end and a lower end. The lower end of the second outwardly curved portion is coupled to the upper end of the lower portion of the second arm. Each outwardly curved portion has a length of 0.75 inches, plus or minus 20 percent.

Next provided are a first knob 10 at the upper end of the first outwardly curved portion and a second knob 10 at the upper end of the second outwardly curved portion. The knobs are enlarged with respect to the arms and ellipsoid in configuration. The device is fabricated of nylon in a one piece construction.

The arms may take any of a plurality of shapes. Note FIGS. 5, 6, and 7 wherein the arms have a circular cross sectional configuration, a square cross sectional configuration, and a hexagonal cross sectional configuration.

The device is reconfigurable between an open inoperative orientation and a closed operative orientation. The arms are generally parallel when the device is in the open inoperative orientation with an opening 9 between the outwardly curved portions for receiving, securing, and releasing a pair of garments and with a curved open area 8 there beneath. The arms are intertwined when in the closed operative orientation which performs the function of securing together the garments for laundering.

Although the present invention is disclosed herein as securing stockings together for laundering as the preferred primary embodiment, it should be realized that the present invention has a wide variety of usages including, for example, a clothes pin.

The present invention is a simple device to quickly, easily and safely pair garments, such as stockings/socks for laundering and storing. It requires no hardware installation (snaps, tabs, buttons, hook and loop etc.) or garment preparation and is much easier to use than the prior art.

The majority of apparatuses for holding and fastening pairs of garments together for laundering are sock holding/attachment devices, most of which are a version of clips, clasps, clamps, connectors, pins, bands, and snaps. Many of these mechanisms require taking time to permanently fasten them to the garment, which may damage or distort the garment. Stress created in the laundering environment may further damage the area where these devices attach to the garment. Other apparatuses often don't work well, allowing the socks to come apart during laundering. In addition, many of them are difficult to use, especially for children and elderly people who may have smaller or weaker hands, or for those with medical conditions such as arthritis.

Various aspects of the present invention are superior to the prior art. It is easier to use. There are no awkward snaps, clips, clamps or buttons etc. to negotiate. No difficult squeezing, pressing, buttoning etc. of the device is required to operate. Children and elderly people will especially find it easier to use.

The present invention is faster to use than the prior art and therefore time saving.

The present invention won't damage clothing as some prior art apparatuses can. There is no piercing, clamping, marking, taping or snagging of fabrics with the present invention.

The present invention will accommodate thick and thin socks. Some prior art devices will not.

The present invention is inexpensive to produce.

The present invention is lightweight and less noisy in dryers than some bulky apparatuses.

The device 7 is a thin, solid, one-piece elongated loop of plastic, which can be injection-molded from stiff, flexible, water resistant and heat resistant plastic, such as nylon.

Other similar resilient materials may be used and/or other manufacturing methods may be employed. The device 7 consists of two elongated curvilinear arms 11 symmetrically aligned in a parallel orientation in the same plane and conjoined in a "U" orientation at a vertex 12 on one end, extending and curving slightly outward at a slight angle on either side (forming a shallow curved open area 8 in the center of device 7). The curvilinear arms 11 then curve inward in the same plane toward each other, approaching but not touching, and finally curve outward again, ending in a position symmetrically opposed to each other in a "Y" pattern, forming an entrance opening 9 between them.

Integrated onto the ends of the curvilinear arms 11 are ellipsoid knobs 10 oriented with their long dimension in a perpendicular position relative to the plane formed by the curvilinear arms 11. The ellipsoid knobs 10 allow the two opposing curvilinear arms 11 to be twisted together with the fingers of one hand and interlocked in a stressed locked position via the two ellipsoid knobs 10. The outward curved portion 6 of the curvilinear arms 11 near the ellipsoid knobs 10 enables the curvilinear arms 11 to twist and intertwine, and the ellipsoid knobs 10 to interlock. This action results in the interlocking of the curvilinear arms 11 in an intertwined position creating tension along the length of the curvilinear arms 11 that allows the device 7 to maintain clamping pressure on paired garments. The curved open area 8 in consonance with the dynamics of the twisted curvilinear arms 11, also allows the device 7 to accommodate various thicknesses of paired garments while still securely retaining them.

Paired garments are held securely by the interlocked curvilinear arms 11 that are locked by the ellipsoid knobs 10.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stocking pairing device (7) for holding together a pair of stockings (4) to be laundered and for securing and releasing such pair of stockings, the device comprising, in combination:

a pair of stockings to be held together during laundering, the pair of stockings having a first end and a second end and an intermediate extent there between;

a pair of arms (11) including a first arm and a second arm, each arm having a curvilinear configuration, each arm having a lower portion and an upper portion;

a U-shaped vertex (12) coupling the first arm and the second arm, the arms having a circular cross sectional configuration with a first circumference and the vertex having a second circumference greater than the first circumference;

a first outwardly curved portion (6) with an upper end and a lower end coupled to the upper end of the lower portion of the first arm, a second outwardly curved portion (6) with an upper end and a lower end coupled to the upper end of the lower portion of the second arm, the first outwardly curved portion and the second outwardly curved portion forming a planar opening for receiving the intermediate extent of the pair of stockings in a planar configuration during laundering, the first outwardly curved portion and the second outwardly curved portion crossing each other during laundering;

a first knob (10) at the upper end of the first outwardly curved portion and a second knob (10) at the upper end of the second outwardly curved portion, the knobs being enlarged with respect to the arms, the device being fabricated of nylon in a one piece construction; and the device being reconfigurable between an open inoperative orientation and a closed operative orientation, the arms being generally parallel when in the open inoperative orientation with an opening (9) between the outwardly curved portions for receiving, encompassing, securing, and releasing a pair of stockings with a curved open area (8) there beneath, the arms intertwining when in the closed operative orientation which performs the function of securing the garments for laundering, the intertwining being with the arms spanning the intermediate extent of the pair of stockings, the intertwining also being with the arms adjacent to the knobs which are spaced at a distance from the pair of stockings.

2. The system as set forth in claim 1 wherein each arm has a diameter of 0.125 inches plus or minus 20 percent, and each arm has a length of 3.5 inches, plus or minus 20 percent.

3. The system as set forth in claim 1 wherein the U-shaped vertex has a length of 0.25 inches, plus or minus 20 percent.

4. The system as set forth in claim 1 wherein the knobs are ellipsoid in configuration.

* * * * *